US007042148B2

(12) United States Patent
Ahn et al.

(10) Patent No.: US 7,042,148 B2
(45) **Date of Patent: *May 9, 2006**

(54) FIELD EMISSION DISPLAY HAVING REDUCED POWER REQUIREMENTS AND METHOD

(75) Inventors: Kie Y. Ahn, Chappaqua, NY (US); Leonard Forbes, Corvallis, OR (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/789,479

(22) Filed: Feb. 26, 2004

(65) Prior Publication Data

US 2004/0169453 A1 Sep. 2, 2004

Related U.S. Application Data

(63) Continuation of application No. 09/140,623, filed on Aug. 26, 1998, now Pat. No. 6,710,538.

(51) Int. Cl.
*H01J 1/304* (2006.01)
*H01J 1/62* (2006.01)

(52) U.S. Cl. ..... 313/497; 313/495; 313/496; 445/24

(58) Field of Classification Search ..... 313/495–497, 313/309, 310, 311, 351, 336; 445/24
See application file for complete search history.

(56) References Cited

U.S. PATENT DOCUMENTS

| | | | | |
|---|---|---|---|---|
| 3,665,241 | A | 5/1972 | Spindt et al. | 313/351 |
| 3,755,704 | A | 8/1973 | Spindt et al. | 313/309 |
| 3,812,559 | A | 5/1974 | Spindt et al. | 29/25 |
| 3,954,523 | A | 5/1976 | Magdo et al. | 438/409 |
| 4,016,017 | A | 4/1977 | Aboaf et al. | 438/441 |
| 4,266,233 | A | 5/1981 | Bertotti et al. | 257/271 |
| 4,652,467 | A | 3/1987 | Brinker et al. | 427/246 |
| 4,857,161 | A | 8/1989 | Borel et al. | 445/24 |
| 4,987,101 | A | 1/1991 | Kaanta et al. | 438/619 |

(Continued)

OTHER PUBLICATIONS

Anderson, R.C. et al., "Porous Polycrystalline Silicon: A New Material for MEMS," *Journal of Microelectrochemical Systems* 3(1):10-18, 1994.

(Continued)

*Primary Examiner*—Karabi Guharay
(74) *Attorney, Agent, or Firm*—Dorsey & Whitney LLP

(57) ABSTRACT

A field emission display includes a substrate and a plurality of emitters formed on columns on the substrate. The display also includes a porous dielectric layer formed on the substrate and the columns. The porous dielectric layer has an opening formed about each of the emitters and has a thickness substantially equal to a height of the emitters above the substrate. The porous dielectric layer may be formed by oxidation of porous polycrystalline silicon. The display also includes an extraction grid formed substantially in a plane defined by respective tips of the plurality of emitters and having an opening surrounding each tip of a respective one of the emitters. The display further includes a cathodoluminescent-coated faceplate having a planar surface formed parallel to and near the plane of tips of the plurality of emitters. The porous dielectric layer results in columns having less capacitance compared to prior art displays. Accordingly, less electrical power is required to charge and discharge the columns in order to drive the emitters. As a result, the display is able to form luminous images while consuming reduced electrical power compared to prior art displays.

34 Claims, 7 Drawing Sheets

U.S. PATENT DOCUMENTS

| | | | | |
|---|---|---|---|---|
| 5,103,288 | A | 4/1992 | Dakamoto et al. | 257/758 |
| 5,142,184 | A | 8/1992 | Kane | 313/309 |
| 5,186,670 | A | 2/1993 | Doan et al. | 445/24 |
| 5,194,780 | A | 3/1993 | Meyer | 315/169.3 |
| 5,229,331 | A | 7/1993 | Doan et al. | 437/228 |
| 5,259,799 | A | 11/1993 | Doan et al. | 445/24 |
| 5,358,908 | A | 10/1994 | Reinbert et al. | 438/20 |
| 5,372,973 | A | 12/1994 | Doan et al. | 437/228 |
| 5,430,300 | A | 7/1995 | Yue et al. | 445/450 |
| 5,458,518 | A | 10/1995 | Lee | 445/24 |
| 5,470,801 | A | 11/1995 | Kapoor et al. | 438/471 |
| 5,473,222 | A | 12/1995 | Theony et al. | 315/169.1 |
| 5,483,067 | A | 1/1996 | Fujii et al. | 250/338.3 |
| 5,529,524 | A | 6/1996 | Jones | 445/24 |
| 5,569,058 | A | 10/1996 | Gnade et al. | 445/24 |
| 5,578,896 | A | 11/1996 | Huang | 313/309 |
| 5,585,301 | A | 12/1996 | Lee et al. | 437/60 |
| 5,597,444 | A | 1/1997 | Gilton | 156/643 |
| 5,647,785 | A | 7/1997 | Jones et al. | 445/24 |
| 5,651,713 | A | 7/1997 | Lee et al. | 445/50 |
| 5,653,619 | A | 8/1997 | Cloud et al. | 445/24 |
| 5,663,608 | A | 9/1997 | Jones et al. | 313/309 |
| 5,684,356 | A | 11/1997 | Jeng et al. | 445/70 |
| 5,712,534 | A | 1/1998 | Lee et al. | 315/169.3 |
| 5,793,154 | A | 8/1998 | Itoh et al. | 313/308 |
| 5,804,910 | A | 9/1998 | Tjaden et al. | 313/310 |
| 5,853,492 | A | 12/1998 | Cathey et al. | 134/3 |
| 5,869,169 | A | 2/1999 | Jones | 428/213 |
| 5,898,258 | A | 4/1999 | Sakai et al. | 313/309 |
| 6,028,322 | A | 2/2000 | Moradi | 257/10 |
| 6,232,705 | B1 | 5/2001 | Forbes et al. | 313/309 |
| 6,251,470 | B1 | 6/2001 | Forbes et al. | 427/97 |
| 6,255,156 | B1 | 7/2001 | Forbes et al. | 438/235 |
| 6,277,765 | B1 | 8/2001 | Cheng et al. | 438/773 |
| 6,333,215 | B1 | 12/2001 | Matsuda et al. | 438/149 |
| 6,710,538 | B1 | 3/2004 | Ahn et al. | 313/311 |
| 6,835,111 | B1 | 12/2004 | Ahn et al. | 445/24 |

OTHER PUBLICATIONS

Boswell, E.C. et al., "Polycrystalline Silicon Field Emitters," 8th International Vacuum Microelectronics Conference Technical Digest, pp. 181-186, 1996.

Boswell, E.C. et al., "Polycrystalline silicon field emitters," *J Vac Sci Technol. B* 14(3):1910-1913, 1996.

Huang, W.N. et al., "Photoluminescence in porous sputtered polysilicon films formed by chemical etching," *Semicond. Sci. Technol*. 12:228-233, 1997.

Huang, W.N. et al., "Properties of chemically etched porous polycrystalline silicon deposited by r.f. sputtering," IEEE Hong Kong Electron Devices Meeting, pp. 21-24, 1996.

Huq, S.E. et al., "Comparative study of gated single crystal silicon and polysilicon field emitters," *J. Vac . Sci. Technol. B* 15(6):2855-2858, 1997.

Huq, S.E. et al., "Fabrication of Gated Polycrystalline Silicon Field Emitters," 9th International Vacuum Microelectronics Conference, St. Petersburg, pp. 367-370, 1996.

Kim, I.H. et al., "Metal FEAs on Double Layer Structure of Polycrystalline Silicon," 9th International Vacuum Microelectronics Conference, St. Petersburg, pp. 423-426, 1996.

Kim, I.H. et al., "Fabrication of metal field emitter arrays on polycrystalline silicon," *J. Vac. Sci. Technol. B* 15(2):468-471, 1997.

Ku, T.K. et al., "Enhanced Electron Emission from Phosphorus-Doped Diamond-Clad Silicon Field Emitter Arrays," *IEEE Electron Device Letters* 17(5):208-210, 1996.

Lacher, F. et al., "Electron field emission from thin fine-grained CVD diamond films," *Diamond and Related Materials* 6:1111-1116, 1997.

Lazarouk, S. et al., "Electrical characterization of visible emitting electroluminescent Schottky diodes based on n-type porous silicon and on highly doped n-type porous polysilicon," *Journal of Non-Crystalline Solids* 198-200: 973-976, 1996.

Lee, J.H. et al., "A New Fabrication Method of Silicon Field Emitter Array with Local Oxidation of Polysilicon and Chemical-Mechanical-Polishing," 9th International Vacuum Microelectronics Conference, St. Petersburg, pp. 415-418, 1996.

Lee, K.R. et al., "Field emission behavior of (nitrogen incorporated) diamond-like carbon films," *Thin Solid Films* 290-291:171-175, 1996.

Litovchenko, V.G. et al., "Emission Properties of the Silicon Cathodes Coated with Doped Diamond-Like Carbon Films," IEEE International Conf. On Plasma Science, p. 308, Abstract 7A02, 1997.

Pullen, S.E. et al., "Enhanced Field Emission from Polysilicon Emitters Using Porous Silicon," 9th International Vacuum Microelectronics Conference, St. Petersburg, pp. 211-214, 1996.

Uh, H.S. et al., "Enhanced Electron Emission and Its Stability from Gated Mo-polycide Field Emitters," IEEE, pp. 713-716, 1997.

Uh, H.S. et al., "Fabrication and Characterization of Gated n+ Polycrystalline Silicon Field Emitter Arrays," 9th International Vacuum Microelectronics Conference, St. Petersburg, pp. 419-422, 1996.

Uh, H.S., "Process design and emission properties of gated n+ polycrystalline silicon field emitter arrays for flat-panel display applications," *J. Vac. Sci. Technol. B* 15(2):472-476, 1997.

Vaudaine, P. and Meyer, R., "Microtips Fluorescent Display," technical digest of IEDM 91, pp. 197-200, 1991.

FIELD EMISSION DISPLAY HAVING REDUCED POWER REQUIREMENTS AND METHOD

CROSS-REFERENCE TO RELATED APPLICATION

This application is a continuation of U.S. patent application Ser. No. 09/140,623, filed Aug. 26, 1998, now U.S. Pat. No. 6,710,538.

TECHNICAL FIELD

This invention relates to field emission displays, and, more particularly, to a method and apparatus for reducing power consumption in field emission displays.

BACKGROUND OF THE INVENTION

FIG. 1 is a simplified side cross-sectional view of a portion of a display 10 including a faceplate 20 and a baseplate 21, in accordance with the prior art. FIG. 1 is not drawn to scale. The faceplate 20 includes a transparent viewing screen 22, a transparent conductive layer 24 and a cathodoluminescent layer 26. The transparent viewing screen 22 supports the layers 24 and 26, acts as a viewing surface and forms a hermetically sealed package between the viewing screen 22 and the baseplate 21. The viewing screen 22 may be formed from glass. The transparent conductive layer 24 may be formed from indium tin oxide. The cathodoluminescent layer 26 may be segmented into pixels yielding different colors to provide a color display 10. Materials useful as cathodoluminescent materials in the cathodoluminescent layer 26 include $Y_2O_3$:Eu (red, phosphor P-56), $Y_3(Al, Ga)_5O_{12}$:Tb (green, phosphor P-53) and $Y_2(SiO_5)$:Ce (blue, phosphor P-47) available from Osram Sylvania of Towanda Pa. or from Nichia of Japan.

The baseplate 21 includes emitters 30 formed on a surface of a substrate 32. The substrate 32 is coated with a dielectric layer 34 that is formed, in accordance with the prior art, by deposition of silicon dioxide via a conventional TEOS process. The dielectric layer 34 is formed to have a thickness that is approximately equal to or just less than a height of the emitters 30. This thickness may be on the order of 0.4 microns, although greater or lesser thicknesses may be employed. A conductive extraction grid 38 is formed on the dielectric layer 34. The extraction grid 38 may be, for example, a thin layer of polycrystalline silicon. An opening 40 is created in the extraction grid 38 having a radius that is also approximately the separation of the extraction grid 38 from the tip of the emitter 30. The radius of the opening 40 may be about 0.4 microns, although larger or smaller openings 40 may also be employed.

In operation, signals coupled to the emitter 30 allow electrons to flow to the emitter 30. Intense electrical fields between the emitter 30 and the extraction grid 38 then cause field emission of electrons from the emitter 30. A positive voltage, ranging up to as much as 5,000 volts or more. but generally 2,500 volts or less, is applied to the faceplate 20 via the transparent conductive layer 24. The electrons emitted from the emitter 30 are accelerated to the faceplate 20 by this voltage and strike the cathodoluminescent layer 26. This causes light emission in selected areas known as pixels, i.e., those areas adjacent to the emitters 30, and forms luminous images such as text, pictures and the like.

FIG. 2 is a simplified plan view showing rows 42 and columns 44 of the emitters 30 and the openings 40 of FIG. 1, according to the prior art. The columns 44 are divided into top columns 44*a* and bottom columns 44*b*, as may be seen in FIG. 2. Top 46*a* and bottom 46*b* column driving circuitry is coupled to the top 44*a* and bottom 44*b* columns, respectively. A row driving circuit 48 is coupled to odd rows 42*a* and even rows 42*b*. The rows 42 are formed from strips of the extraction grid 38 that are electrically isolated from each other. The columns 44*a* and 44*b* are formed from conductive strips that are electrically isolated from each other and that electrically interconnect groups of the emitters 30.

By biasing a selected one of the rows 42 to an appropriate voltage and also biasing a selected one of the columns 44 to a voltage that is about forty to eighty volts more negative than the voltage applied to the selected row 42, the emitter or emitters 30 located at an intersection of the selected row 42 and column 44 are addressed. The addressed emitter or emitters 30 then emit electrons that travel to the faceplate 20, as described above with respect to FIG. 1.

Conventional circuitry for driving emitters 30 in field emission displays 10 enables each column 44 once per row address interval and disables each column 44 once per row address interval. The columns 44 present a capacitive load C. Charging and discharging of the capacitance C consumes power in proportion to $fCV^2$, where f represents the frequency of charging and discharging the column 44 and V represents the voltage to which the columns 44 are charged. Charging and discharging of the columns 44 in order to drive the emitters 30 forms a major component of the electrical power consumed by the display 10. As a result, reducing the frequency f, the capacitance C or the voltage V can significantly reduce the electrical power required to operate the display 10. Displays 10 requiring less electrical power are currently in demand.

There is therefore need for techniques and apparatus that reduce the amount of electrical power required in order to operate field emission displays.

SUMMARY OF THE INVENTION

In one aspect, the present invention includes a field emission display having a substrate and a plurality of emitters formed on the substrate. Each of the emitters is formed on one of a plurality of emitter conductors that is also a row or a column of the display. The display also includes a porous dielectric layer formed on the substrate and the columns. The porous dielectric layer has an opening formed about each of the emitters and has a thickness substantially equal to a height of the emitters above the substrate. The porous dielectric layer is preferably formed by oxidation of porous polycrystalline silicon. The display further includes an extraction grid formed substantially in a plane defined by respective tips of the plurality of emitters. The extraction grid has an opening surrounding each tip of a respective one of the emitters. The display additionally includes a cathodoluminescent-coated faceplate having a planar surface formed parallel to and near the plane of tips of the plurality of emitters.

The porous dielectric results in the emitter conductors having reduced capacitance C compared to prior art dielectric layers. Charging and discharging of the emitter conductors in order to drive the emitters forms a major component of the electrical power consumed by the display. By reducing the capacitance of the emitter conductors, the display is able to form luminous images, such as text and the like, while dissipating reduced electrical power.

In another aspect of the present invention, tips of the emitters are formed from a material having a work function less than four electron volts. The voltage needed in order to drive the emitters, and hence the voltage used to charge and discharge the columns, is proportional to a turn-on voltage for the emitters. Emitters having reduced turn-on voltage draw less electrical power. As a result, baseplates with emitters having low work function tips are able to form luminous images while dissipating reduced electrical power compared to conventional displays.

DETAILED DESCRIPTION OF THE INVENTION

Figure 1:
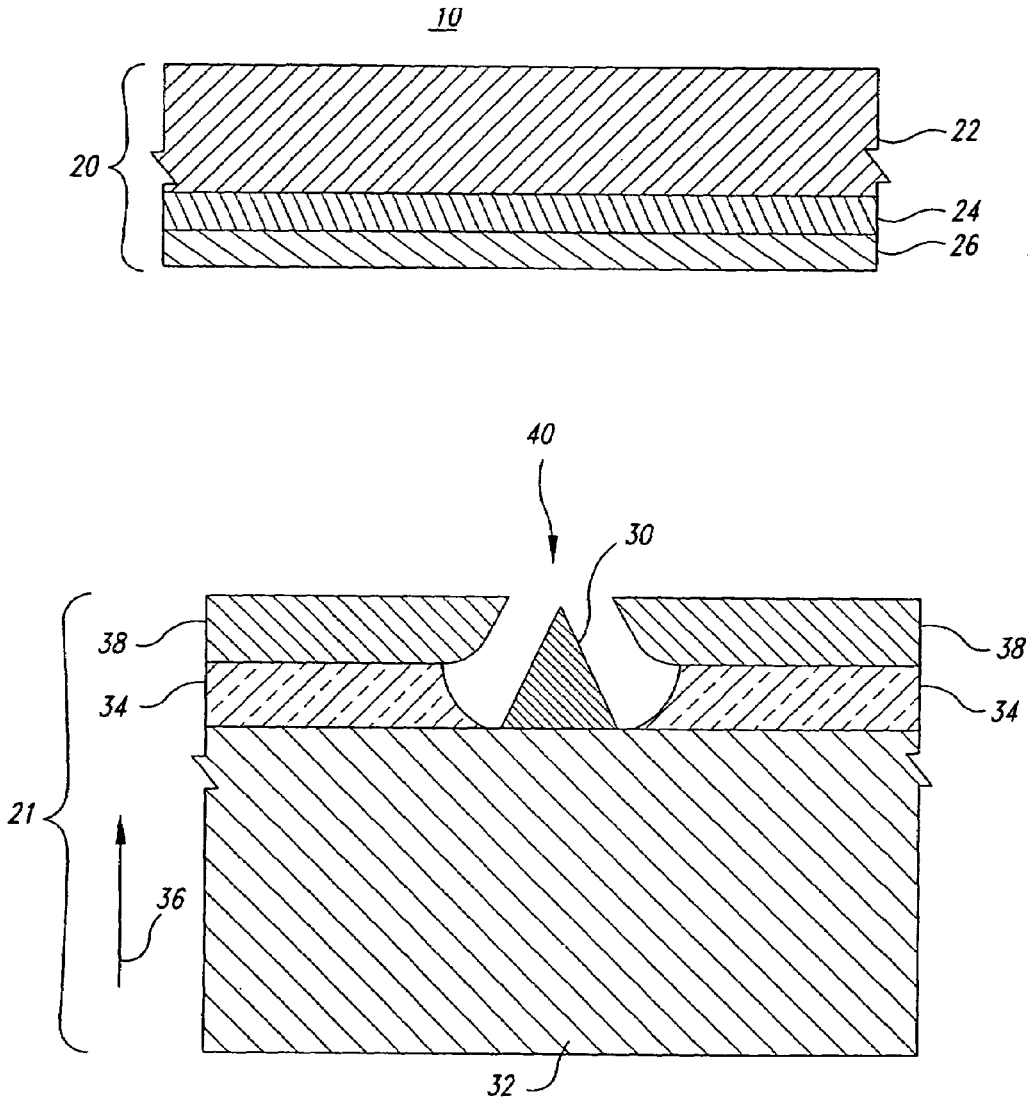
Fig. 1 (PRIOR ART)
FIG. 1 is a simplified side cross-sectional view of a portion of a display including a faceplate and a baseplate, in accordance with the prior art.
Figure 2:
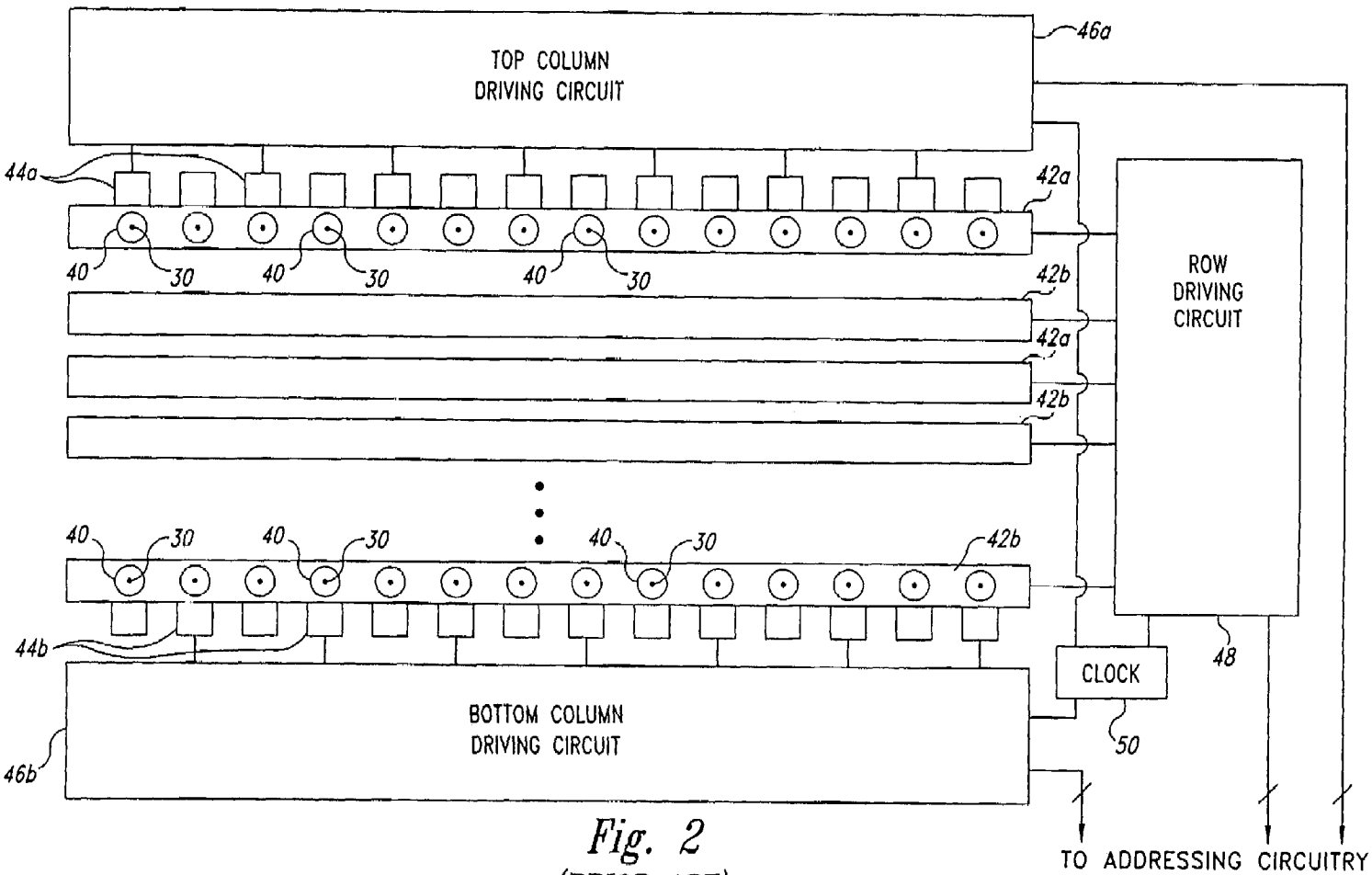
Fig. 2 (PRIOR ART)
FIG. 2 is a simplified plan view showing rows and columns of the emitters of FIG. 1, in accordance with the prior art.
Figure 3:
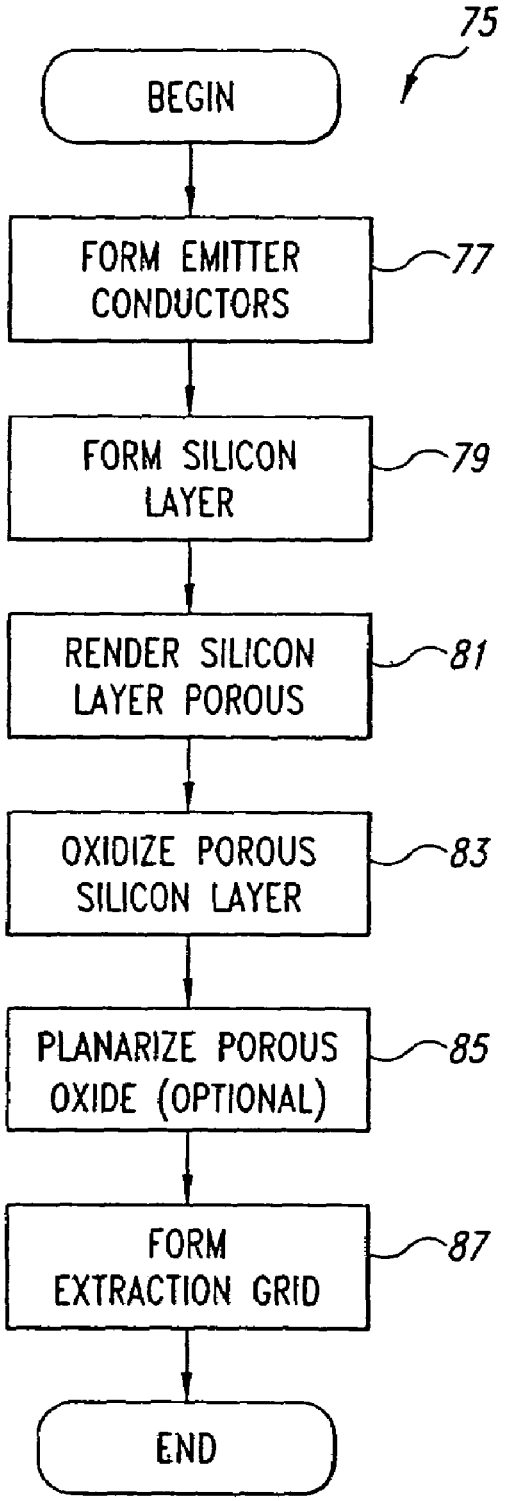
FIG. 3 is a simplified flowchart of a process for forming a dielectric having a reduced relative dielectric constant $\in_R$, in accordance with embodiments of the present invention.

FIG. 3 is a simplified flowchart of a process 75 for forming a dielectric layer 34' (not shown in FIG. 3) having a reduced relative dielectric constant $\in_R$, relative to the prior art, in accordance with embodiments of the present invention. The process 75 begins with a step 77 of forming emitter conductors defining columns 44 (FIG. 2) on the substrate 32 (FIG. 1). In a step 79, a silicon layer (not shown) is formed on the substrate 32 and on the emitter conductors/columns 44 by conventional processes. In one embodiment, the step 79 includes forming the silicon layer by conventional deposition of polysilicon.

In a step 81, the silicon layer is made porous. In one embodiment, the step 81 includes forming voids or pores (not shown) in an n-type silicon layer by a process similar to that described in "Formation Mechanism of Porous Silicon Layers Obtained by Anodization of Monocrystalline n-type Silicon in HF Solutions" by V. Dubin, Surface Science 274 (1992), pp. 82–92. In one embodiment, a current density of between 5 and 40 mA/cm$^2$ is employed together with 12–24% HF. In general, increasing $N_D$ (silicon donor concentration), HF concentration or anodization current density provides larger pores.

In another embodiment, the step 81 includes forming voids or pores in a p-type silicon layer by a process similar to that described in "On the morphology of Porous Silicon Layers Obtained by Electrochemical Method" by G. Graciun et al., International Semiconductor Conference CAS '95 Proceedings (IEEE Catalog No. 95TH8071) (1995), pp. 331–334. In one embodiment, a current density of between 1.5 and 30 mA/cm$^2$ is employed together with either 36 weight % HF-ethanol 1:1 or 49 weight % HF-ethanol 1:3.

In one embodiment, the silicon layer is anodized or etched until a porosity of greater than 50% is achieved, i.e., more than one-half of the volume of the silicon layer is converted to pores or voids. In another embodiment, the silicon layer is anodized or etched until a porosity of greater than 75% is achieved.

In a step 83, the porous silicon layer is oxidized. In one embodiment, the oxidation of the step 83 is carried out by conventional thermal oxidation at a temperature in excess of 950 to 1,000° C. In another embodiment, an inductively-coupled oxygen-argon mixed plasma is employed for oxidizing the silicon layer, as described in "Low-Temperature Si Oxidation Using Inductively Coupled Oxygen-Argon Mixed Plasma" by M. Tabakomori et al., Jap. Jour. Appl. Phys., Part 1, Vol. 36, No. 9A (September 1997), pp. 5409–5415. In yet other embodiments, electron cyclotron resonance nitrous oxide plasma is employed for oxidizing the silicon, as described in "Oxidation of Silicon Using Electron Cyclotron Resonance Nitrous Oxide Plasma and its Application to Polycrystalline Silicon Thin Film Transistors", J. Lee et al., Jour. Electrochem. Soc., Vol. 144, No. 9 (September 1997), pp. 3283–3287 and "Highly Reliable Polysilicon Oxide Grown by Electron Cyclotron Resonance Nitrous Oxide Plasma" by N. Lee et al., IEEE E1. Dev. Lett., Vol. 18, No. 10 (October 1997), pp. 486–488. Plasma oxidation allows the temperature of the baseplate 21 (FIG. 1) to be as low as 450–500° C. during the step 83.

Oxidation of the porous silicon layer results in the porous silicon dioxide layer 34' (not shown in FIG. 3), having a porosity that is related to that of the porous silicon layer. One volume of silicon oxidizes to provide approximately 1.55 volumes of silicon dioxide. Accordingly, a silicon layer having 50% voids will, after complete oxidation, result in the porous silicon dioxide layer 34' having approximately 22.5% voids (ignoring any expansion of the porous silicon dioxide layer 34' in the vertical direction during oxidation). Similarly, a silicon layer having 75% voids will, after complete oxidation, result in the porous silicon dioxide layer 34' having approximately 61.5% voids. Either of these examples will result in the porous silicon dioxide layer 34' having a relative dielectric constant $\in_R$ that is substantially reduced compared to a dielectric layer 34 formed from silicon dioxide incorporating no voids ($\in_R \cong 3.9$).

In one embodiment, a relative dielectric constant $\in_R$ of less than 3 is provided, corresponding to a void content of about 25% in the porous silicon dioxide layer 34'. In another embodiment, a relative dielectric constant $\in_R$ of less than 1.6 is provided, corresponding to a void content of about 60% in the porous silicon dioxide layer 34'. In some embodiments, the porous silicon dioxide layer 34' forms a series of columnar spacers.

In an optional step 85, the porous silicon dioxide layer 34' is planarized. The step 85 may include conventional chemical-mechanical polishing, or may include formation of a layer of dielectric material having planarizing properties (e.g., conventional TEOS deposition). In a step 87, the extraction grid 38 is formed on the porous silicon dioxide layer 34' using conventional techniques and is etched to provide the rows 42 (FIG. 2). Although the field emission display is described as having emitters arranged in columns and the extraction grid arranged in rows, it will be understood that the emitters alternatively may form rows and the extraction grid may form columns. The process 75 then ends.

Figure 4:
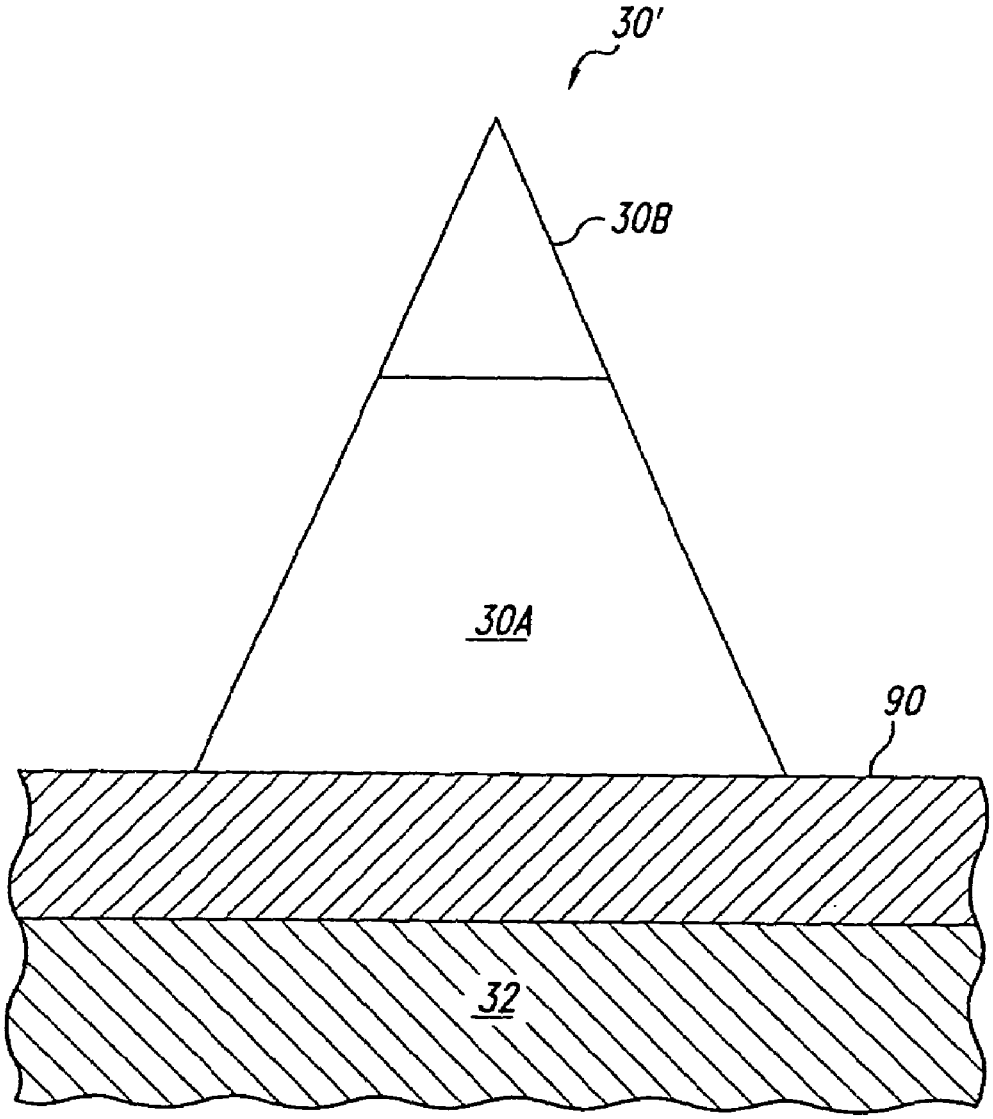
FIG. 4 is a simplified side view of an emitter having a body formed of high resistivity material and a tip formed of a low work function material, in accordance with embodiments of the present invention.

FIG. 4 is a simplified side view of an emitter 30' having an emitter body 30A formed of high resistivity material and an emitter tip 30B formed of a low work function material, in accordance with embodiments of the present invention. The emitter body 30A is formed on one of the columns 44 of FIG. 2. Advantages to forming the emitter body 30A from a high resistivity material include current limiting, and equalizing the current drawn by the emitters 30' despite the emitters 30' having different turn-on voltages. Current limiting also obviates catastrophic failure of the display 10 (FIG. 1) in the event that one or more emitters 30' become short-circuited to the extraction grid 38. In one embodiment, resistance values for the emitter body 30A may fall into the range of 4 MΩ to 40 MΩ for conventional drive voltages V and may be less if the turn-on voltage for the emitter 30' is reduced. In one embodiment, the emitters 30' have emitter bodies 30A formed from material having a resistivity ρ of ca. $10^{2-103}$ Ω-cm and emitter tips 30B formed from materials having a work function ϕ or electron affinity χ of less than four eV, or even three eV or less.

Advantages to forming emitters 30' to have tips 30B formed from a metal having a low work function ϕ, or a semiconductor having a low electron affinity χ, include reduced turn-on voltage for the emitter 30'. As a result, the emitters 30' do not require as large a voltage V in order to be able to bombard the faceplate 20 with sufficient electrons to form the desired images. Power consumption for the display 10 is then reduced.

Representative values for work functions ϕ or electron affinities χ for several materials are summarized below in Table I. Measured or achieved work functions ϕ/ electron affinities χ depend strongly on surface treatment and surface contamination and may vary from the values given in Table I.

TABLE I

Metal work functions ϕ and semiconductor electron affinities χ for selected materials.

| ϕ or χ (eV) | Material |
|---|---|
| 4.3 | W |
| 4.05* | Si (χ) |
| 3.6/3.7* | SiC (χ) |
| 3.6 | Zr |
| 3.3 | La |
| 3–3.3 | Zn |
| 2.9 | TiN |
| 2.8 | $LaB_6$ |
| 2.6 | Ce |
| 1.8–2.2 | Ba |
| 1.4** | C (diamond, χ) |
| 0.9–4.05 | Silicon oxycarbide (projected, χ) |

*depending on surface treatment.
**diamond can manifest different values, including negative values.

Figure 5:
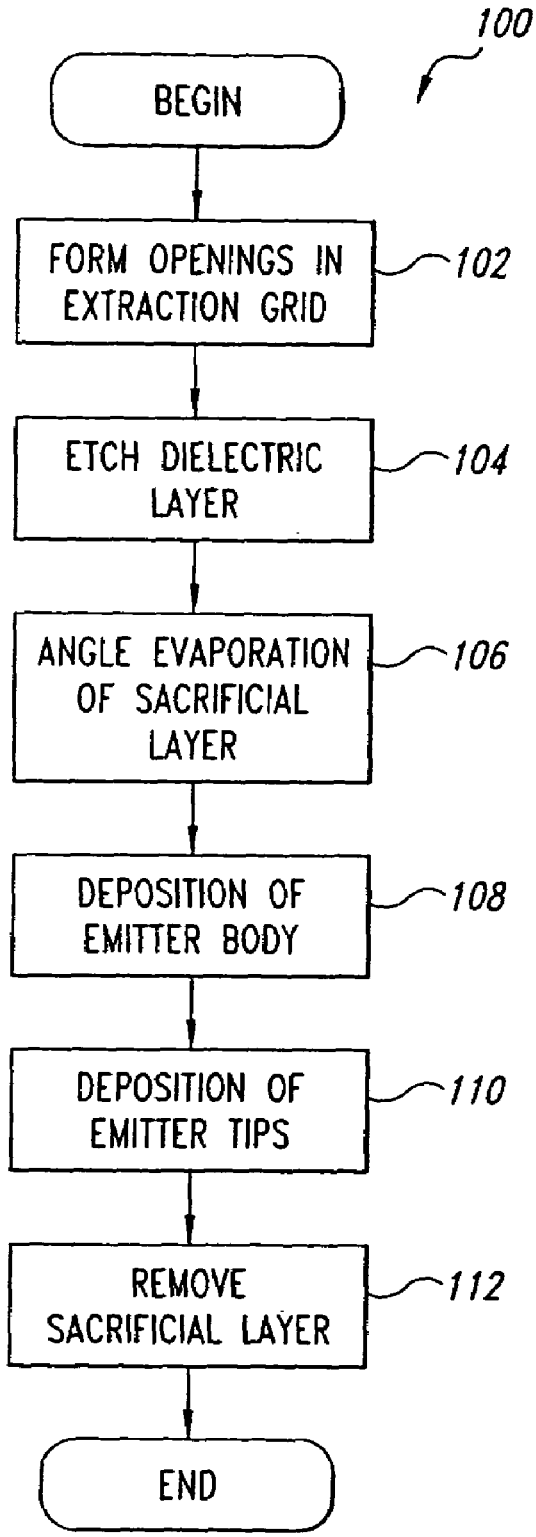
FIG. 5 is a simplified flowchart of a process for forming emitters having reduced work function and integral ballast resistors, in accordance with embodiments of the present invention.

FIG. 5 is a simplified flowchart of a process 100 for forming the emitters 30' of FIG. 4, in accordance with embodiments of the present invention. FIGS. 6A–6G show the baseplate 21 at various stages in the formation of the emitters 30 or 30', in accordance with embodiments of the present invention. In one embodiment, the process 100 results in emitters 30' having tips 30B providing reduced work function ϕ and emitter bodies 30A providing integral ballast resistors. In another embodiment, the process 100 results in emitters 30 that are formed after the porous silicon dioxide layer 34 is formed.

Figure 6A:
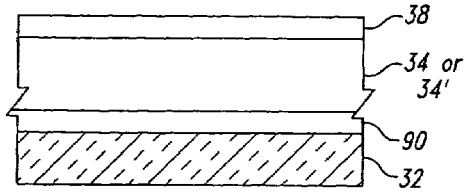
FIGS. 6A–6G show the baseplate at various stages in the process of emitter formation, in accordance with embodiments of the present invention.
Figure 6B:
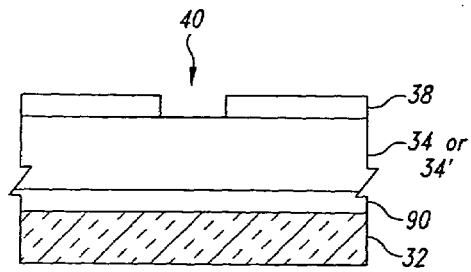
Figure 6C:
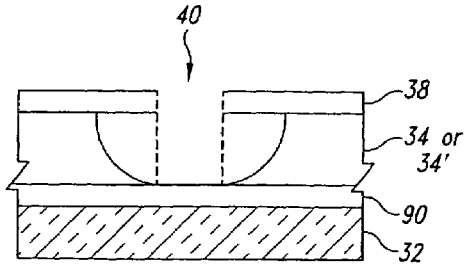
Figure 6D:
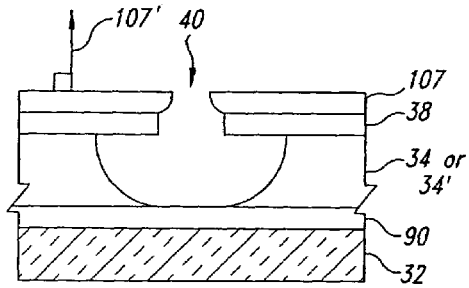
Figure 6E:
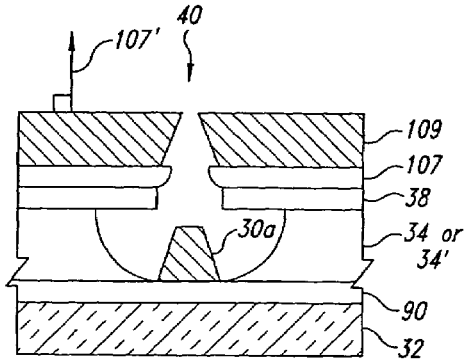
Figure 6F:
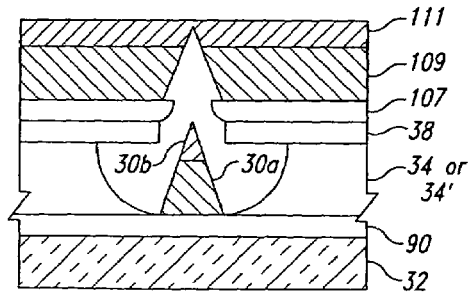
Figure 6G:
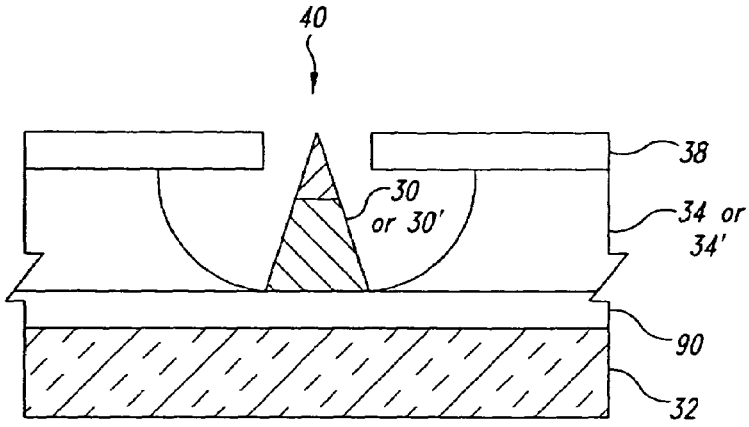

FIG. 6A shows a conductor 90 forming the columns 44 (FIG. 2), the dielectric layer 34 or the porous silicon dioxide layer 34' and the extraction grid 38, which were previously formed on the substrate 32. The process 100 begins with a step 102 of forming the openings 40 in the extraction grid 38 (FIG. 6B). The openings 40 may be formed by conventional lithography and etching. In a step 104, the dielectric layer 34 or 34' is etched to expose the conductor 90 (FIG. 6C). The step 104 may use conventional wet chemical etching (e.g., etching using buffered oxide etch, a standard HF solution) to provide a curved edge profile, shown as a solid trace in FIG. 6C, or may use reactive ion etching to provide a vertical edge profile, shown as a dashed trace in FIG. 6C.

In a step 106, a sacrificial layer 107 (FIG. 6D) is formed. The sacrificial layer 107 is formed on the extraction grid 38 but not on the conductor 90. In one embodiment, the sacrificial layer 107 is formed by evaporation of, e.g., nickel, from a point source such as an electron beam evaporator, so that the nickel atoms approach the extraction grid 38 at an angle of ca. 75° or more from a normal (see direction arrow 107') to the extraction grid 38, causing interiors of the openings 40 to be shadowed from the incoming nickel atoms. The baseplate 21 is rotated about the normal 107' to the extraction grid 38 during this evaporation to provide uniform coverage of the extraction grid 38 by the sacrificial layer 107.

In a step 108, the emitter body 30A is formed of high resistivity material (FIG. 6E) by deposition of a layer 109. In one embodiment, the emitter body 30A forms the bottom two-thirds of the overall height of the emitter 30'.

In one embodiment, the emitter body 30A is formed by co-evaporation of SiO together with Mn to provide the layer 109 and the emitter body 30A having 7–10 atomic percent Mn, as described in "Conduction Mechanisms In Co-Evaporated Mixed Mn/$SiO_x$ Thin Films" by S. Z. A. Zaidi, Jour. of Mater. Sci. 32, (1997), pp. 3349–3353. Other embodiments may employ SiO formed as described in "Production of $SiO_2$ Films Over Large Substrate Area by Ion-Assisted Deposition of SiO With a Cold Cathode Source" by I. C. Stevenson, Soc. of Vac. Coaters, Proc. $36^{TH}$ Annual Tech. Conf. (1993), pp. 88–93 or "Improvement of the ITO-P Interface in α-Si:H Solar Cells using a Thin SiO Intermediate Layer" by C. Nunes de Carvalho et al., Proc. MRS Spring Symposium, Vol. 420 (1996), pp. 861–865, together with a co-deposited metal. Other metals (e.g., Cr, Au, Cu etc.) may be used to form cermet or cermet-like materials as described by Zaidi et al.

In a step 110, the emitter tips 30B are formed (FIG. 6F) by deposition of a layer 111. In one embodiment, the layer 111 and the emitter tips 30B are formed by evaporation of one of the materials listed in Table I that are amenable to deposition by vacuum evaporation. TiN may be formed in situ by evaporation of a thin Ti film (e.g., two hundred Angstroms or more) followed by rapid thermal annealing in a nitrogen-bearing atmosphere (e.g., ammonia). In other embodiments, other materials may be sputtered or may be deposited by chemical vapor deposition.

In one embodiment, silicon oxycarbide is employed as the emitter tips 30B in the step 110. A process for forming thin microcrystalline films of silicon oxycarbide is described in "Transport Properties of Doped Silicon Oxycarbide Microcrystalline Films Produced by Spatial Separation Techniques" by R. Martins et al., Solar Energy Materials and Solar Cells 41/42 (1996), pp. 493–517. A diluent/reaction gas (e.g., hydrogen) is introduced directly into a region where plasma ignition takes place. The mixed gases containing the species to be deposited are introduced close to the region where the growth process takes place, often a substrate heater. A bias grid is located between the plasma ignition and the growth regions, spatially separating the plasma and growth regions.

Deposition parameters for producing doped microcrystalline $Si_x:C_y:O_z:H$ films may be defined by determining the hydrogen dilution rate and power density that lead to microcrystallization of the grown film. The power density is typically less than 150 milliWatts per $cm^3$ for hydrogen dilution rates of 90% +, when the substrate temperature is about 250° C. and the gas flow is about 150 sccm. The composition of the films may then be varied by changing the partial pressure of oxygen during film growth to provide the desired characteristics.

In one embodiment, SiC is employed as the emitter tips 30B in the step 110. SiC films may be fabricated by chemical vapor deposition, sputtering, laser ablation, evaporation, molecular beam epitaxy or ion implantation of carbon into silicon. Vacuum annealing of silicon substrates is a method that may be used to provide SiC layers having thicknesses ranging from 20 to 30 nanometers, as described in "Localized Epitaxial Growth of Hexagonal and Cubic SiC Films on Si by Vacuum Annealing" by Luo et al., Appl. Phys. Lett. 69(7), (1996), pp. 916–918. This embodiment requires that the emitter tip 30B either be formed from or be coated with silicon. Prior to vacuum annealing, the emitters 30' are degreased with acetone and isopropyl alcohol in an ultrasonic bath for fifteen minutes, followed by cleaning in a solution of $H_2SO_4:H_2O_2$ (3:1) for fifteen minutes. A five minute rinse in deionized water then precedes etching with a 5% HF solution. The emitters 30' are blown dry using dry nitrogen and placed in the vacuum chamber and the chamber is pumped to a base pressure of $1–2\times10^{-6}$ Torr. The substrate is heated to 750 to 800° C. for half an hour to grow the microcrystalline SiC film.

In some embodiments, silicon is employed as the emitter tips 30B in the step 110. Methods for depositing high quality polycrystalline films of silicon on silicon dioxide substrates are given in "Growth of Polycrystalline Silicon at low Temperature on Hydrogenated Microcrystalline Silicon (μc-Si:H) Seed Layer" by Parks et al., Proceedings of the 1997 MRS Spring Symposium, Vol. 467 (1997), pp. 403–408, "Novel Plasma Control Method in PECVD for Preparing Microcrystalline Silicon" by Nishimiya et al., Proceedings of the 1997 MRS Spring Symposium, Vol. 467 (1997), pp. 397–401 and "Low Temperature (450° C.) Poly-Si Thin Film Deposition on $SiO_2$ and Glass Using a Microcrystalline-Si Seed Layer" by D. M. Wolfe et al., Proceedings of the 1997 MRS Spring Symposium, Vol. 472 (1997), pp. 427–432. A process providing grain sizes of about 4 nm is described in "Amorphous and Microcrystalline Silicon Deposited by Low-Power Electron-Cyclotron Resonance Plasma-Enhanced Chemical-Vapor Deposition" by J. P. Conde et al., Jap. Jour. Appl. Phys., Part I, Vol. 36, No. 1A (June 1997), pp. 38–49. Deposition conditions favoring small grain sizes for microcrystalline silicon include high hydrogen dilution, low temperature, low deposition pressure and low source-to-substrate separation.

Following the step 110, the sacrificial layer 107 is removed, along with those portions of the layers 109 and 111 that do not form parts of the emitters 30', in a step 112. In one embodiment, a nickel sacrificial layer 107 is removed using electrochemical etching of the nickel. Other conventional approaches for forming and later removing sacrificial layers 107 may also be used when they are compatible with the processes of the steps 106–112. The process 100 then ends and further processing is carried out using conventional fabrication techniques.

In one embodiment, emitters 30 formed from a single material are provided together with the porous silicon dioxide layer 34' formed as described in conjunction with FIG. 3 by performing the steps 102–106, performing a step 110' (not illustrated) of depositing a single material and then performing step 112. In this embodiment, the advantages of the porous silicon dioxide layer 34' may be provided together with conventional emitters 30.

It will be appreciated that the porous silicon dioxide layer 34' may be formed after formation of the emitters 30. In these embodiments, the emitters 30 may be conventionally formed before or after the step 77 of FIG. 3. The steps 79–87 may, in some embodiments, follow the formation of the emitters 30 or 30'. In these embodiments, conventional chemical-mechanical polishing followed by etching of the porous silicon dioxide layer 34' results in a baseplate 21 (FIG. 1) useful in field emission displays 10.

Figure 7:
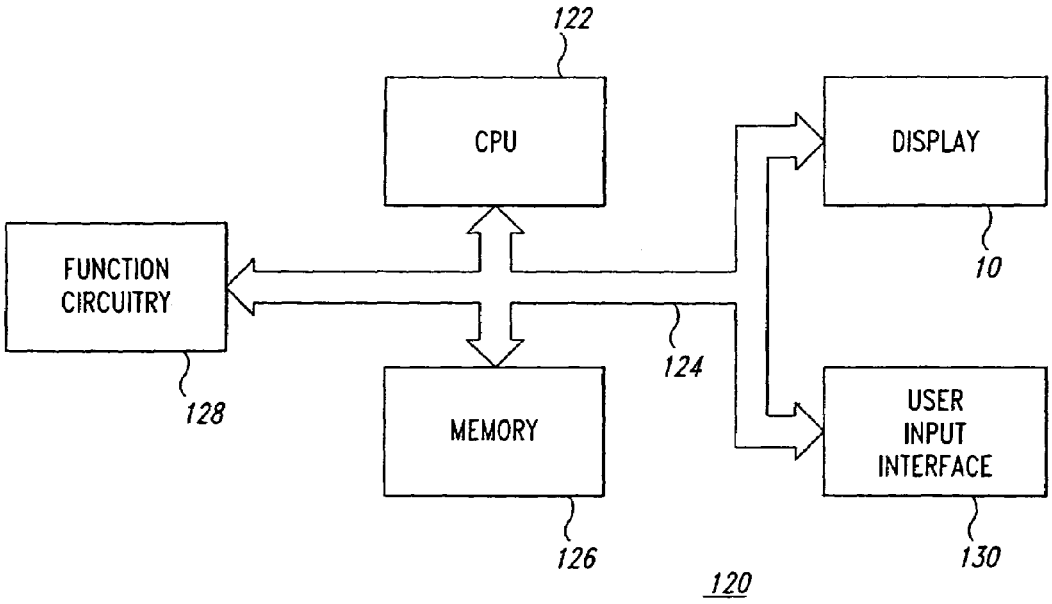
FIG. 7 is a simplified block diagram of a computer including a field emission display, in accordance with embodiments of the present invention.

FIG. 7 is a simplified block diagram of a portion of a computer 120 including the field emission display 10, in accordance with the invention as described with reference to FIGS. 3–6 and associated text. The computer 120 includes a central processing unit 122 coupled via a bus 124 to a memory 126, function circuitry 128, a user input interface 130 and the field emission display 10, according to embodiments of the present invention. The memory 126 may or may not include a memory management module (not illustrated) and does include ROM for storing instructions providing an operating system and a read-write memory for temporary storage of data. The processor 122 operates on data from the memory 126 in response to input data from the user input interface 130 and displays results on the field emission display 10. The processor 122 also stores data in the read-write portion of the memory 126. Examples of systems where the computer 120 finds application include personal/portable computers, camcorders, televisions, automobile electronic systems, microwave ovens and other home and industrial appliances.

Field emission displays 10 for such applications provide significant advantages over other types of displays, including reduced power consumption, improved range of viewing angles, better performance over a wider range of ambient lighting conditions and temperatures and higher speed with which the display can respond. Field emission displays find application in most devices where, for example, liquid crystal displays find application.

Although the present invention has been described with reference to a preferred embodiment, the invention is not limited to this preferred embodiment. Rather, the invention is limited only by the appended claims, which include within their scope all equivalent devices or methods which operate according to the principles of the invention as described.

The invention claimed is:

1. A field emission display baseplate comprising:

a substrate having an upper surface;

a plurality of spaced-apart conductors formed on the substrate;

a plurality of spaced-apart emitter bodies comprising a high resistivity material formed on the conductors;

a porous silicon dioxide layer including respective openings coaxial with the emitter bodies, the porous silicon dioxide layer disposed over and bonded to the upper surface of the substrate and the conductors, the porous silicon dioxide layer comprising about 22.5 to about 61.5 percent voids and a relative dielectric constant of less than three;

an extraction grid formed on the porous silicon dioxide layer and including respective openings coaxial with the emitter bodies; and an emitter tip formed on each of the emitter bodies in the extraction grid opening, the tip formed from a material having a work function or electron affinity of less than four electron volts.

2. The baseplate of claim 1 wherein the porous silicon dioxide layer comprises at least 50% voids.

3. The baseplate of claim 1 wherein the porous silicon dioxide layer has a relative dielectric constant of less than 1.6.

4. The baseplate of claim 1 wherein the emitter tip comprises a material selected from a group consisting of: SiC, Zr, La, Zn, TiN, $LaB_6$, Ce, Ba, diamond and silicon oxycarbide.

5. The baseplate of claim 1 wherein the emitter body comprises:

silicon monoxide; and a metal.

6. The baseplate of claim 1 wherein the emitter body comprises:

silicon monoxide; and less than 10 atomic percent manganese.

7. The baseplate of claim 1 wherein the porous silicon dioxide layer has a mechanically planarized upper surface and wherein the extraction grid is formed on the mechanically planarized upper surface of the porous silicon dioxide layer.

8. A field emission display baseplate comprising:

a substrate having an upper surface;

a plurality of conductors formed on the substrate;

a plurality of emitters each formed on one of the plurality of conductors;

an oxidized porous polysilicon layer disposed over and bonded to the upper surface of the substrate and the conductors;

an extraction grid formed on the oxidized porous polysilicon layer and including an opening;

an opening formed in the oxidized porous polysilicon layer coaxial with the opening in the extraction grid;

an emitter body comprising a high resistivity material formed in the opening in the oxidized porous polysilicon layer; and an emitter tip formed on the emitter body and in the extraction grid opening, the tip formed from a material having a work function or electron affinity of less than four electron volts.

9. The baseplate of claim 8 wherein the oxidized porous polysilicon layer comprises about 22.5 to about 61.5 percent voids and a relative dielectric constant of less than three.

10. The baseplate of claim 8 wherein the oxidized porous polysilicon layer comprises about 22.5 to about 61.5 percent voids and a relative dielectric constant of less than 1.6.

11. The baseplate of claim 8 wherein the oxidized porous polysilicon layer has a mechanically planarized upper surface and wherein the extraction grid is formed on the mechanically planarized upper surface of the oxidized porous polysilicon layer.

12. A field emission display baseplate comprising:

a substrate having an upper surface;

a plurality of spaced-apart conductors formed on the substrate;

an oxidized porous polysilicon layer disposed over and bonded to the upper surface of the substrate and the conductors;

an extraction grid formed on the oxidized porous polysilicon layer and including an opening;

an opening formed in the oxidized porous polysilicon layer coaxial with the opening in the extraction grid; and an emitter formed in the opening in the oxidized porous polysilicon layer and in the extraction grid opening.

13. The baseplate of claim 12 wherein the oxidized porous polysilicon layer comprises about 22.5 to about 61.5 percent voids and a relative dielectric constant of less than three.

14. The baseplate of claim 12 wherein the oxidized porous polysilicon layer comprises about 22.5 to about 61.5 percent voids and a relative dielectric constant of less than 1.6.

15. The baseplate of claim 12 wherein emitter comprises:

an emitter body comprising a high resistivity material; and an emitter tip formed on the emitter body and in the extraction grid opening.

16. The baseplate of claim 15 wherein the emitter tip comprises a material selected from a group consisting of: SiC, Zr, La, Zn, TiN, $LaB_6$, Ce, Ba, diamond and silicon oxycarbide.

17. The baseplate of claim 15 wherein the emitter body comprises:

silicon monoxide; and a metal.

18. The baseplate of claim 15 wherein the emitter body comprises:

silicon monoxide; and less than 10 atomic percent manganese.

19. The baseplate of claim 12 wherein the oxidized porous polysilicon layer has a mechanically planarized upper surface and wherein the extraction grid is formed on the mechanically planarized upper surface of the oxidized porous polysilicon layer.

20. A field emission display comprising:

a substrate having an upper surface;

a plurality of emitters formed on the substrate, each of the emitters being formed on a conductor;

a porous silicon dioxide layer disposed over and bonded to the upper surface of the substrate and the conductors, the porous silicon dioxide layer comprising about 22.5 to about 61.5 percent voids and a relative dielectric constant of less than three, the porous silicon dioxide layer including respective openings formed about each of the emitters;

an extraction grid extraction grid formed substantially in a plane defined by respective tips of the plurality of emitters and having an opening surrounding each tip of a respective one of the emitters; and a cathodoluminescent-coated faceplate having a planar surface formed parallel to and near the plane of tips of the plurality of emitters.

21. The display of claim 20 wherein the porous silicon dioxide layer comprises at least 50% voids.

22. The display of claim 20 wherein the porous silicon dioxide layer has a relative dielectric constant of less than 1.6.

23. The display of claim 20 wherein each of the emitters comprise:

an emitter body comprising a high resistivity material; and an emitter tip formed on the emitter body and in the extraction grid opening.

24. The display of claim 23 wherein:

the emitter tips each comprise a material selected from a group consisting of: SiC, Zr, La, Zn, TiN, $LaB_6$, Ce, Ba, diamond and silicon oxycarbide; and the emitter bodies each comprise a cermet material.

25. The baseplate of claim 23 wherein the emitter bodies each comprise:

silicon monoxide; and less than 10 atomic percent metal.

26. The baseplate of claim 20 wherein the porous silicon dioxide layer has a mechanically planarized upper surface.

27. A computer system comprising:

a central processing unit;

a memory device coupled to the central processing unit, the memory device storing instructions and data for use by the central processing unit;

an input interface; and a display, the display comprising:

a cathodoluminescent layer formed on a conductive surface of a transparent faceplate;

a substrate having an upper surface, the substrate disposed substantially parallel to and near the cathodoluminescent layer formed on the faceplate;

a plurality of conductors formed on the substrate;

a plurality of emitters formed on the conductors;

a porous silicon dioxide layer including respective openings formed about each of the emitter bodies, the porous silicon dioxide layer disposed over and bonded to the upper surface of the substrate and the conductors, the porous silicon dioxide layer comprising about 22.5 to about 61.5 percent voids and a relative dielectric constant of less than three; and an extraction grid formed on the porous silicon dioxide layer and including openings each coaxial with one of the openings in the porous silicon dioxide layer.

28. The computer system of claim 27 wherein the porous silicon dioxide layer has a relative dielectric constant of less than 1.6.

29. The computer system of claim 27 wherein the porous silicon dioxide layer comprises at least 50% voids.

30. The computer system of claim 27 wherein each of the emitters comprises:

an emitter body comprising a high resistivity material; and an emitter tip formed on the emitter body and in the extraction grid opening.

31. The computer system of claim 30 wherein:

the emitter tips each comprise a material selected from a group consisting of: SiC, Zr, La, Zn, TiN, $LaB_6$, Ce, Ba, diamond and silicon oxycarbide; and the emitter bodies each comprise a cermet material.

32. The computer system of claim 30 wherein the emitter bodies each comprise:

silicon monoxide; and less than 10 atomic percent metal.

33. The computer system of claim 30 wherein tips of the emitters are formed from materials having a work function of less than four electron volts.

34. The baseplate of claim 27 wherein the porous silicon dioxide layer has a planarized upper surface and wherein the extraction grid is formed on the mechanically planarized upper surface of the porous silicon dioxide layer.

* * * * *